US011022294B2

(12) United States Patent
Bukkems et al.

(10) Patent No.: US 11,022,294 B2
(45) Date of Patent: Jun. 1, 2021

(54) LIGHTING MODULE AND A LUMINAIRE COMPRISING THE LIGHTING MODULESPE

(71) Applicant: SIGNIFY HOLDING B.V., Eindhoven (NL)

(72) Inventors: Peter Johannes Martinus Bukkems, Deurne (NL); Simon Eme Kadijk, Veldhoven (NL); Simon Jacobus Maria Kuppens, Geldrop (NL); Johannes Gerrit Jan Beijer, Bavel (NL); Vincent Stefan David Gielen, Gastel (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/467,789

(22) PCT Filed: Dec. 6, 2017

(86) PCT No.: PCT/EP2017/081705
§ 371 (c)(1),
(2) Date: Jun. 7, 2019

(87) PCT Pub. No.: WO2018/104393
PCT Pub. Date: Jun. 14, 2018

(65) Prior Publication Data

US 2019/0331333 A1 Oct. 31, 2019

(30) Foreign Application Priority Data

Dec. 9, 2016 (EP) ..... 16203095

(51) Int. Cl.
*F21V 29/71* (2015.01)
*F21S 8/08* (2006.01)
(Continued)

(52) U.S. Cl.
CPC ..... *F21V 29/713* (2015.01); *F21K 9/232* (2016.08); *F21S 8/086* (2013.01); *F21V 29/74* (2015.01); *F21V 29/83* (2015.01)

(58) Field of Classification Search
CPC ..... F21S 8/086; F21V 29/60; F21V 9/713; F21V 29/83; F21W 2131/10
See application file for complete search history.

(56) References Cited

U.S. PATENT DOCUMENTS 7,278,761 B2 10/2007 Kuan
9,119,247 B2 8/2015 Arik et al.
(Continued)

FOREIGN PATENT DOCUMENTS

CN 101839464 A 9/2010
CN 202153949 U 3/2012
(Continued)

*Primary Examiner* — Joseph L Williams
*Assistant Examiner* — Jacob R Stern
(74) *Attorney, Agent, or Firm* — Daniel J. Piotrowski

(57) ABSTRACT

The invention provides a lighting module (100) for use in a luminaire (200). The lighting module comprises a base (101) having a longitudinal axis (LA) which comprises an electrical connector (102) for connecting the lighting module (100) to a luminaire socket (201) of the luminaire (200). The lighting module (100) further comprises a driver unit (103) which comprises a driver circuit (104) which is electrically connected to the electrical connector (102). The lighting module (100) further comprises a light unit (105) which comprises at least one solid state light source (106) which is electrically connected to the driver circuit (104) and emits light. The lighting module (100) further comprises a heat sink (107) which removes heat from the at least one solid state light source (106). The heat sink (107) comprises an elongated hollow tube (108) which extends in the direction of the longitudinal axis (LA) and comprises a fluid inlet
(Continued)

(109) and a fluid outlet (110), wherein the heat sink (107) is arranged between the driver unit (103) and the light unit (105).

14 Claims, 4 Drawing Sheets

(51) Int. Cl.
*F21V 29/74* (2015.01)
*F21V 29/83* (2015.01)
*F21K 9/232* (2016.01)

(56) References Cited

U.S. PATENT DOCUMENTS

| | | | | |
|---|---|---|---|---|
| 9,464,801 | B2 | 10/2016 | Van De Ven et al. | |
| 2010/0207502 | A1 | 8/2010 | Cao et al. | |
| 2010/0208460 | A1* | 8/2010 | Ladewig | F21V 29/51 362/235 |
| 2012/0236602 | A1 | 9/2012 | Flaherty et al. | |
| 2012/0287637 | A1 | 11/2012 | Mahalingam et al. | |
| 2013/0271004 | A1 | 10/2013 | Mon et al. | |
| 2019/0017667 | A1* | 1/2019 | Mitchell | F21V 29/773 |

FOREIGN PATENT DOCUMENTS

| | | | |
|---|---|---|---|
| CN | 103874883 | A | 6/2014 |
| CN | 102734710 | B | 10/2014 |
| CN | 104251628 | A | 12/2014 |
| CN | 105308389 | A | 2/2016 |
| JP | 3203785 | B2 | 3/1994 |
| JP | 2013524409 | A | 6/2013 |
| TW | 201120369 | A | 6/2011 |
| WO | 2010003300 | A1 | 1/2010 |
| WO | 2013071013 | A1 | 5/2013 |
| WO | 2016026695 | A1 | 2/2016 |
| WO | 2017184700 | A1 | 10/2017 |

* cited by examiner

LIGHTING MODULE AND A LUMINAIRE COMPRISING THE LIGHTING MODULESPE

CROSS-REFERENCE TO PRIOR APPLICATIONS

This application is the U.S. National Phase application under 35 U.S.C. § 371 of International Application No. PCT/EP2017/081705, filed on Dec. 6, 2017, which claims the benefit of European Patent Application No. 16203095.1 filed on Dec. 9, 2016. These applications are hereby incorporated by reference herein.

FIELD OF THE INVENTION

The present invention relates to a lighting module and to a luminaire comprising the lighting module.

BACKGROUND OF THE INVENTION

TW201120369 discloses a sealed outdoors LED lighting lamp. The sealed outdoors LED lighting lamp has a sealed hollow shell, a reflective cover, a LED module and a fan. The reflective cover is disposed in the sealed hollow shell to partition an inner chamber and an outer chamber relatively independent with each other, and forms an air channel communicated between the inner chamber and the outer chamber on one end of the sealed hollow shell. The LED module is disposed in the sealed hollow shell, and has a heat sinking passage therein, in which the heat sinking passage forms another channel communicated between the inner chamber and the outer chamber on another end of the sealed hollow shell. The fan is set in the shell for speeding air flowed between the inner chamber and the outer chamber.

US 2012/0287637 A1 discloses an illumination device which comprises a housing equipped with an aperture, first and second diaphragms disposed in said housing and in fluidic communication with said aperture, and an LED disposed between said first and second diaphragms US 2010/0207502 A1 discloses a three dimensional LED arrangement and heat management method using a heat transfer or conduction pipe to enable rapid heat transfer from a three dimensional cluster of LEDs to a heatsink with or without active cooling. The light emitted from the three dimensional cluster is not obstructed by a heat sink arrangement such that the light beam profile generated by the light appears similar to that generated by traditional incandescent bulbs.

U.S. Pat. No. 9,119,247 B2 discloses lighting systems which have unique configurations. For instance, the lighting system may include a light source, a thermal management system and driver electronics, each contained within a housing structure. The light source is configured to provide illumination visible through an opening in the housing structure. The thermal management system is configured to provide an air flow, such as a unidirectional air flow, through the housing structure in order to cool the light source. The driver electronics are configured to provide power to each of the light source and the thermal management system US 2012/0236602 A1 discloses an LED-based lamp assembly with a driver assembly having a base portion rotateably engageable with the socket of a light fixture to make a first electrical contact with the light fixture. The driver assembly has an electrically conductive, retractable tip portion coupled to the base portion and that makes a second electrical contact with the light fixture. The tip portion retracts relative to the base when in electrical contact with the light fixture's socket portion. A lamp housing assembly operably connected to the driver assembly has a lamp housing connected to the driver assembly. The lamp housing is coupled to at least one substrate having at least one LED light thereon. The substrate is connected to, or is an integral part of, a heat sink that carries heat away from the substrate and/or LED light. The lamp housing assembly is rotatable relative to the light fixture to adjust the angular position of the light source.

SUMMARY OF THE INVENTION

In view of the above, a concern of the present invention is to provide a lighting module which allows for optimal cooling of a light unit in an existing luminaire. For example, the invention describes a lighting module for a street lighting luminaire which enables the use of more LEDs on a heat sink or driving the LEDs on a heat sink at a higher current in order to increase the lumen output or brightness of the lighting module. It is also an object of the invention to provide a compact lighting module for emitting high intensity light that has a better thermal management. Better thermal management increases both the efficiency and the lifetime of the light source.

To address this concern, a lighting module in accordance with the independent claim is provided. Preferred embodiments are defined by the dependent claims.

According to a first aspect of the invention, a lighting module for use in a luminaire is provided which comprises a base having a longitudinal axis and comprises an electrical connector for connecting the lighting module to a luminaire socket. The lighting module further comprises a driver unit comprising a driver circuit electrically connected to the electrical connector. The lighting module further comprises a light unit comprising at least one solid state light source electrically connected to the driver circuit and configured for emitting light. The light module further comprises a heat sink configured for removing heat from the at least one solid state light source, the heat sink comprises an elongated hollow tube extending in the direction of the longitudinal axis and comprising a fluid inlet and a fluid outlet, wherein the heat sink is arranged between the driver unit and the light unit.

Hence, the invention provides a lighting module that allows for optimal cooling a light unit in an existing luminaire. The invention provides a lighting module which enables the use of more LEDs on a heat sink or driving the LEDs on a heat sink at a higher current in order to increase the lumen output or brightness of the lighting module. It also provides a compact, light-weight and mechanically strong lighting module for emitting high intensity light that has a better thermal management. The prior art lighting module comprises an elongated channel based heat sink comprising a plurality of fluid inlet holes and a fluid outlet opening wherein a power supply is positioned in the elongated channel. According to the present invention the lighting module comprises an elongated hollow tube based heat sink with a fluid inlet and a fluid outlet, wherein the hollow tube is arranged between the driver unit and the light unit. The effect is that no heat generating element or fluid flow obstacle, such as a power supply, is positioned between the fluid inlet and the fluid outlet of the elongated hollow tube of the heat sink such that it allows for optimal cooling a light unit in an existing luminaire. In addition, the heat sink which comprises an elongated hollow tube separates the light unit and driver unit such that it allows for optimal cooling a light unit in an existing luminaire. In an embodiment, the thermal contact between the driver unit and the elongated hollow tube allows to also cool the driver unit.

The solution proposed in TW201120369 is unable to provide a lighting module that is able to optimal cool a light unit in an existing luminaire. The reason is that the power supply positioned in the elongated channel based heat sink is generating heat and obstructs the fluid flow between a fluid inlet hole and fluid outlet. Thus the solution disclosed in US2012/0236602 will not enable the use of more LEDs on a heat sink or driving the LEDs on a heat sink at a higher current in order to increase the lumen output or brightness of the lighting module. It also does not provide a compact lighting module for emitting high intensity light that has a better thermal management.

In an embodiment, the elongated hollow tube is the heat sink. The elongated hollow tube may have fins. For example, the elongated tube may have fins on the outerside. The obtained effect is improved thermal management i.e. cooling. The positions at the elongated hollow tube where the light unit and driver unit are arranged may not comprise fins. The obtained effect is that the heat fins provide improved thermal management and the positions at the elongated hollow tube where the light unit and driver unit are arranged may not comprise fins an provide good thermal contact between the elongated hollow tube and the light unit and provide good thermal contact between the elongated hollow tube and the driver unit.

In an embodiment, the elongated hollow tube has an average wall thickness. The average wall thickness is preferably in the range from 0.2 mm to 20 mm. More preferably, the elongated hollow tube has an average wall thickness in the range from 0.5 mm to 10 mm. Most preferably, the elongated hollow tube has an average wall thickness in the range from 0.8 mm to 8 mm.

In an embodiment, the elongated hollow tube 108 has a cross-section perpendicular to the longitudinal axis LA which may be squared, rectangular, trapezoid, triangular, pentagonal or hexagonal shaped. The elongated hollow tube has a cross-section perpendicular to the longitudinal axis which may also be round or oval shaped. In case of a round or oval shape it is desired that the light unit and/or driver has a conformal shape according to the round or oval shape of the elongated hollow tube.

In an embodiment, the elongated hollow tube comprises an active cooling device which generates a fluid flow from the fluid inlet to the fluid outlet. This configuration results in a maximum fluid flow in the elongated hollow tube from the fluid inlet to the fluid outlet. The obtained effect is improved cooling of the light unit which enables the use of more LEDs or driving LEDs at a higher current. Better thermal management also increases both the efficiency and the lifetime of the light source. Fluid, such as air, surrounding the edges of the elongated hollow tube and the fluid outlet will also begin to flow in the direction of the fluid flow inside the elongated hollow tube. This process is called entrainment. Entrainment increases cooling of the elongated hollow tube and thus improves cooling of the light unit.

The light unit is positioned on a first surface of the elongated hollow tube and the driver unit is positioned on a second surface of the elongated hollow tube wherein the second surface is opposite to the first surface. This configuration results in a maximum distance and thus separation between the light unit and the driver unit. The obtained effect is improved cooling of the light unit by maximizing the distance between the light unit and the driver unit. Improved cooling enables the use of more LEDs or driving LEDs at a higher current. Better thermal management also increases both the efficiency and the lifetime of the light source. This configuration also results in a compact, light-weight and mechanically strong arrangement.

In an embodiment, the light unit is positioned on a first surface of the elongated hollow tube and the driver unit is positioned on a second surface of the elongated hollow tube wherein the first surface and the second surface extend at an angle in the range from 90 to 180 degrees with respect to each other. For example, the first surface and the second surface extend at an angle of 90 degrees with respect to each other. This configuration results in a separation between the light unit and the driver unit. The elongated hollow tube allows to cool the light unit efficiently. The obtained effect is improved cooling of the light unit by having a distance between the light unit and the driver unit. Improved cooling enables the use of more LEDs or driving LEDs at a higher current. Better thermal management also increases both the efficiency and the lifetime of the light source.

In an embodiment, the elongated hollow tube has a thickness which separates the light unit and the driver unit and a length which extends in the direction of the longitudinal axis. The length of the elongated hollow tube which extends in the direction of the longitudinal axis is at least 5 times the thickness of the elongated hollow tube. More preferably, the length of the elongated hollow tube which extends in the direction of the longitudinal axis is at least 8 times the thickness of the elongated hollow tube. Most preferably, the length of the elongated hollow tube which extends in the direction of the longitudinal axis is at least 10 times the thickness of the elongated hollow tube. This configuration and specific dimensioning result in a maximum length of the elongated hollow tube. The obtained effect is improved cooling of the light unit by maximizing the contact area with and along the length of the light unit. Improved cooling enables the use of more LEDs or driving LEDs at a higher current. Better thermal management also increases both the efficiency and the lifetime of the light source.

In an embodiment, the thickness of the elongated hollow tube is in the range from 5 mm to 50 mm. More preferably, the thickness of the elongated hollow tube is in the range from 8 mm to 40 mm. Most preferably, the thickness of the elongated hollow tube is in the range from 10 mm to 30 mm. The obtained effect is improved cooling of the light unit by maximizing the distance between the light unit and the driver unit and optimizing the dimensioning of the thickness of the elongated hollow tube for obtaining an optimal fluid flow. Improved cooling enables the use of more LEDs or driving LEDs at a higher current. Better thermal management also increases both the efficiency and the lifetime of the light source. This configuration and specific dimensioning also result in a compact, light-weight and mechanically strong arrangement.

In an embodiment, the length of the elongated hollow tube which extends in the direction of the longitudinal axis is in the range from 70 mm to 700 mm. More preferably, the length of the elongated hollow tube which extends in the direction of the longitudinal axis is in the range from 100 mm to 500 mm. Most preferably, the length of the elongated hollow tube which extends in the direction of the longitudinal axis is in the range from 120 mm to 300 mm. The obtained effect is improved cooling of the light unit by maximizing the contact area with the light unit. Improved cooling enables the use of more LEDs or driving LEDs at a higher current. Better thermal management also increases both the efficiency and the lifetime of the light source. The elongated hollow tube also provides mechanical stability.

The elongated hollow tube is low weight and provides good mechanical stability to the light unit and driver unit.

In an embodiment, the fluid inlet is positioned in the first surface and the fluid outlet is positioned in another surface of the elongated hollow tube. The obtained effect is improved cooling of the light unit. The fluid inlet which is positioned in the first surface of the elongated hollow tube enables a cold fluid (e.g. air) intake to cool the assembly with a fluid of the bottom side of the luminaire. The fluid outlet which is positioned in another surface of the elongated hollow tube expels the fluid which has a higher temperature with respect to the fluid at the inlet. The temperature of the fluid (e.g. air) at the first surface of the elongated hollow tube is typically lower than the temperature of the fluid at another surface of the elongated hollow tube when a lighting module configuration according to the invention is used. In this way, improved cooling of the light unit is obtained.

In an embodiment, the fluid inlet is positioned at a distance from a first end of the elongated hollow tube, wherein the distance from the fluid inlet to the first end is maximum 0.2 times the length of the elongated hollow tube. The obtained effect is improved cooling of the light unit. The temperature of the fluid (e.g. air) close the base is typically lower than the temperature of the fluid further away from the base when a lighting module configuration according to the invention is used. In this way, improved cooling of the light unit is obtained. In a preferred embodiment, the fluid inlet is positioned at a distance from the first end of the elongated hollow tube, wherein the distance from the fluid inlet to the first end is maximum 0.1 times the length of the elongated hollow tube.

In an embodiment, the fluid outlet is positioned at a distance from the second end of the elongated hollow tube, wherein the distance from the fluid outlet to the second end of the elongated hollow tube is 0.2 times the length of the elongated hollow tube or less. The obtained effect is improved cooling of the light unit. The temperature of the fluid (e.g. air) further away from the base is typically higher than the temperature of the fluid closer to the base when a lighting module configuration according to the invention is used. In this way, the heated fluid is expelled as far as possible from the fluid inlet. In this way, improved cooling of the light unit is obtained. In a preferred embodiment, the fluid outlet is positioned at a distance from the second end of the elongated hollow tube, wherein the distance from the fluid outlet to the second end of the elongated hollow tube which extends in the direction of the longitudinal axis is at least 0.1 times the length of the elongated hollow tube or less.

In an embodiment, the fluid inlet may be positioned at a distance from the first end of the elongated hollow tube wherein the distance may be 0.2 times the length of the elongated hollow tube or less, the fluid outlet may be positioned at a distance from the second end of the elongated hollow tube wherein the distance is 0.2 times the length L of the elongated hollow tube or less, and wherein the sum of the distances from the fluid inlet to the first end and the fluid outlet to the second end is 0.2 times the length of the elongated hollow tube or less. In a preferred embodiment, the distance between the first inlet of the elongated hollow tube and the second outlet of the elongated hollow tube is at least 0.8 times the length of the elongated hollow tube.

In an embodiment, the driver unit is in thermal contact with the elongated hollow tube to remove heat from the driver unit. The thermal contact between the driver unit and the elongated hollow tube allows to also cool the driver unit. The obtained effect is that both the light unit and the driver unit are cooled but at different positions enabling improved thermal management and thus cooling.

In an embodiment, the driver unit is positioned asymmetrically over the length L of the elongated hollow tube, wherein the center of the driver unit is positioned at a closer distance to the fluid inlet than to the fluid outlet. The obtained effect is that improved cooling of the driver unit. The temperature of the fluid close to the fluid inlet is at a lower temperature than the fluid close to the fluid outlet. In this way, the driver unit is cooled with a fluid having a relatively lower temperature.

In an embodiment, the driver unit comprises a further elongated hollow tube which has a further fluid hole which is in fluid connection with the first mentioned hollow elongated tube. The obtained effect is that improved cooling of the light unit. For example, the lighting module may comprise two separated elongated hollow tubes. In another example, the lighting module may comprise more than one elongated hollow tubes wherein the hollow tubes are connected. The obtained effect is improved mechanical stability and increased heat exchange from tube to the air. In yet another example, the lighting module may comprise two or more elongated hollow tubes wherein the elongated hollow tubes are a single piece structure. The obtained effect is improved mechanical stability. For example, the single piece structure may comprise an array of one by four elongated hollow tubes. In yet another example, the single piece structure may comprise four or more elongated hollow tubes wherein the elongated hollow tubes are arranged in a matrix i.e. an array of (at least) two by two elongated hollow tubes. The obtained effect is improved mechanical stability.

In an embodiment, the lighting module further comprises a rotation mechanism which rotates the elongated hollow tube with respect to the base with respect to the longitudinal axis. The rotation mechanism allows that the light source(s) may be positioned in a direction of a light exit of a reflector of a luminaire. The obtained effect is that the illuminance, i.e. the total luminous flux incident on a surface per unit area e.g. on a road, is increased in an effective and efficient way.

In an embodiment, the light source comprises a plurality of solid state light emitters which are arranged in an elongated solid state light emitter array which extends in the direction of the longitudinal axis and wherein the size of the elongated solid state light emitter array which extends parallel with respect to the longitudinal axis is at least 0.7 times the length of the elongated hollow tube. The obtained effect is increased lumen output of the lighting module. Positioning solid state light emitter e.g. LEDs in a linear configuration enables a relatively small amount of neighbors LED compared to a point source configuration. Thus LEDs in a linear configuration allows improved thermal management compared to a point source configuration. In a more preferred embodiment, the elongated solid state light emitter array is at least 0.8 times the length of the elongated hollow tube. In a most preferred embodiment, the elongated solid state light emitter array is at least 0.9 times the length of the elongated hollow tube.

In an embodiment, a luminaire comprises said lighting module. The obtained effect is that it allows for optimal cooling of a light unit in an existing luminaire.

BRIEF DESCRIPTION OF THE DRAWINGS

Embodiments of the invention will now be described, by way of example only, with reference to the accompanying schematic drawings in which corresponding reference symbols indicate corresponding parts, and in which.

The schematic drawings are not necessarily on scale.

The same features having the same function in different figures are referred to the same references.

DETAILED DESCRIPTION OF THE EMBODIMENTS

Figure 1A:
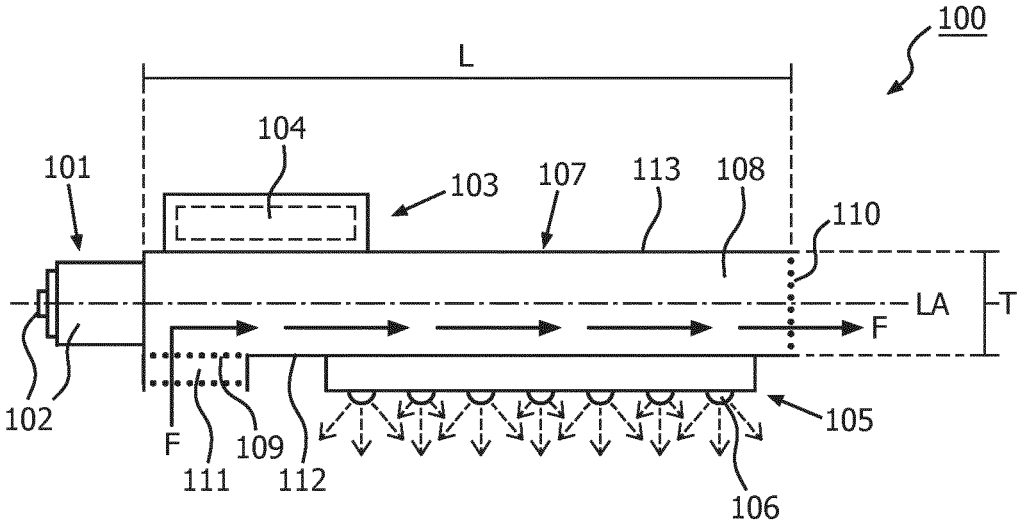
FIGS. 1*a* and 1*b* schematically depict a side view and a front view, respectively, of a lighting module according to an embodiment of the present invention.
Figure 1B:
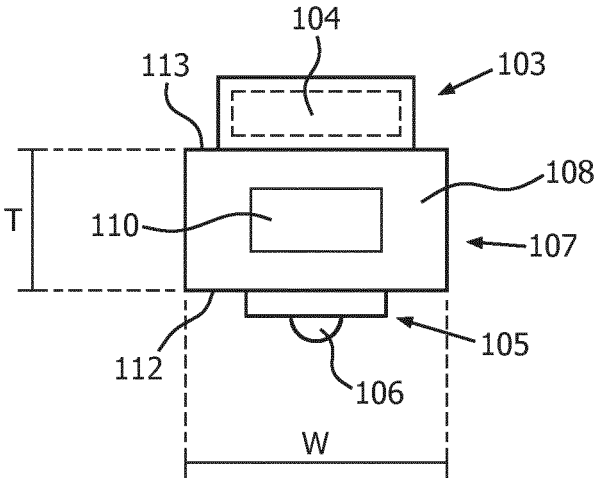

FIGS. 1*a* and 1*b* schematically depict a side view and a front view, respectively, of a lighting module 100 according to an embodiment of the present invention. In the embodiment shown in FIG. 1*a*, the lighting module 100 for use in a luminaire 200 comprises a base 101 which has a longitudinal axis LA and comprises an electrical connector 102 to connect the lighting module 100 to a luminaire socket 201 of the luminaire 200. The lighting module 100 further comprises a driver unit 103 which comprises a driver circuit 104 which is electrically connected to the electrical connector 102. The lighting module 100 further comprises a light unit 105 which comprises at least one solid state light source 106 which is electrically connected to the driver circuit 104 and emits light. The lighting module 100 further comprises a heat sink 107 which removes heat from the at least one solid state light source 106, the heat sink 107 comprises an elongated hollow tube 108 extending in the direction of the longitudinal axis LA and comprising a fluid inlet 109 and a fluid outlet 110, wherein the heat sink 107 is arranged between the driver unit 103 and the light unit 105. No heat generating element or fluid flow obstacle, such as a power supply, is positioned between the fluid inlet 109 and the fluid outlet 110 of the elongated hollow tube 108 of the heat sink 107 such that it allows for optimal cooling a light unit 105. For example, it allows for optimal cooling a light unit 105 in an existing luminaire 200. In addition, the heat sink 107 which comprises an elongated hollow tube 108 separates the light unit 105 and driver unit 103 such that it allows for optimal cooling a light unit 105. The lighting module 100 also provides a compact, light-weight and mechanically strong configuration due to the elongated hollow tube 108. The elongated hollow tube 108 is preferably made from a material with a high thermal conductivity. The thermal conductivity of the elongated hollow tube 108 is preferably at least 50 $W \cdot m^{-1} \cdot K^{-1}$, more preferably at least 100 $W \cdot m^{-1} \cdot K^{-1}$, and most preferably at least 150 $W \cdot m^{-1} \cdot K^{-1}$. For example, the elongated hollow tube 108 is made from a metal, such as aluminium, iron, steel and/or copper, which can be made by metal extrusion or metal bending. The advantage of metal extrusion is that it results in a strong mechanically strong configuration. For example, the thermal conductivity of the elongated hollow tube 108 made of aluminium is about 200 $W \cdot m^{-1} \cdot K^{-1}$. The thermal conductivity of the elongated hollow tube 108 made of copper is about 400 $W \cdot m^{-1} \cdot K^{-1}$. High thermal conductivity is interesting when more high power LEDs are used and more LEDs are concentrated in a small location. The elongated hollow tube 108 may also be made of a thermal plastic. For example, the elongated hollow tube 108 may comprise a plastic and a thermal conductive material e.g. aluminium or copper particles. The elongated hollow tube has an average wall thickness. The average wall thickness is preferably in the range from 0.2 mm to 20 mm. More preferably, the elongated hollow tube has an average wall thickness in the range from 0.5 mm to 10 mm. Most preferably, the elongated hollow tube has an average wall thickness in the range from 0.8 mm to 8 mm. For example, the average wall thickness is 4 mm. Such wall thickness allows for good thermal management i.e. cooling while provide good mechanical stability and still being relatively low-weight.

As depicted in FIG. 1*a*, the elongated hollow tube 108 may be the heat sink 107. The elongated hollow tube 108 may have fins (not shown). For example, the elongated tube 108 may have fins outerside. The obtained effect is improved thermal management i.e. cooling. The positions at the elongated hollow tube 108 where the light unit 105 and driver unit 103 are arranged may not comprise fins.

As depicted in FIG. 1*a*, the elongated hollow tube 108 may further comprise an active cooling device 111. The active cooling device 111 generates a fluid flow from the fluid inlet 109 to the fluid outlet 110. The active cooling device 111 uses energy to cool the light unit 105 directly or indirectly via cooling the heat sink 107 and the elongated hollow tube 108. The active cooling device includes but is not limited to a simple rotary fans, thermoelectric coolers (TECs), piezoelectric fans (PZFs), synthetic jets (SJs) and liquid cooling such as microchannels. In the embodiment shown in FIG. 1*a* the active cooling device 111 is positioned at one end of the elongated hollow tube 108. The elongated hollow tube 108 may also comprise two active cooling devices 111 (not shown). The active cooling device 111 may also be positioned inside the elongated hollow tube 108 (not shown).

As shown in FIG. 1*b*, the light unit 105 is positioned on a first surface 112 of the elongated hollow tube 108 and the driver unit 103 is positioned on a second surface 113 of the elongated hollow tube 108. The second surface 113 is opposite to the first surface 112. For example, the elongated hollow tube 108 has a cross-section perpendicular to the longitudinal axis LA which may be squared, rectangular, trapezoid, triangular, pentagonal or hexagonal shaped. The light unit 105 and driver unit 103 may be positioned on top of a flat surface of the elongated hollow tube 108. The light unit 105 and driver unit 103 may be attached to a surface of the elongated hollow tube 108 by a screw, pin, clamp or any other known suitable manner. The light unit 105 may also be positioned on a first surface 112 of the elongated hollow tube 108 and the driver unit 103 is positioned on a second surface 113 of the elongated hollow tube 108 wherein the first surface 112 and the second surface 113 extend at an angle in the range from 90 to 180 degrees with respect to each other. For example, the first surface 112 and the second surface 113 extend at an angle of 90 degrees with respect to each other.

In the embodiment shown in FIGS. 1*a* and 1*b*, the elongated hollow tube 108 has a thickness T which separates the light unit 105 and the driver unit 103. The elongated hollow tube 108 has a length L which extends in the direction of the longitudinal axis LA. The length L is at least 5 times the thickness T. The length L may also be at least 8 times the thickness T or at least 10 times the thickness T.

In the embodiment shown in FIG. 1*b*, the thickness T is in the range from 5 mm to 50 mm. The thickness T may also be in the range from 8 mm to 40 mm or in the range from 10 mm to 30 mm. For example, the thickness is 12 mm or 15 mm. The width W of the elongated hollow tube is preferably in the range from 0.1 times the thickness T to 10 times the thickness T. More preferably, the width W of the elongated hollow tube is preferably in the range from 0.4 times the thickness T to 3 times the thickness T. Most preferably, the width W of the elongated hollow tube is preferably in the range from 0.5 times the thickness T to 2 times the thickness T. For example the width W is 1 times the thickness T.

In the embodiment shown in FIG. 1*a*, the length L is in the range from 70 mm to 700 mm. The length L may also be in the range from 100 mm to 500 mm or in the range from 120 mm to 300 mm. For example, the length L is 150 mm or 200 mm.

Figure 2A:
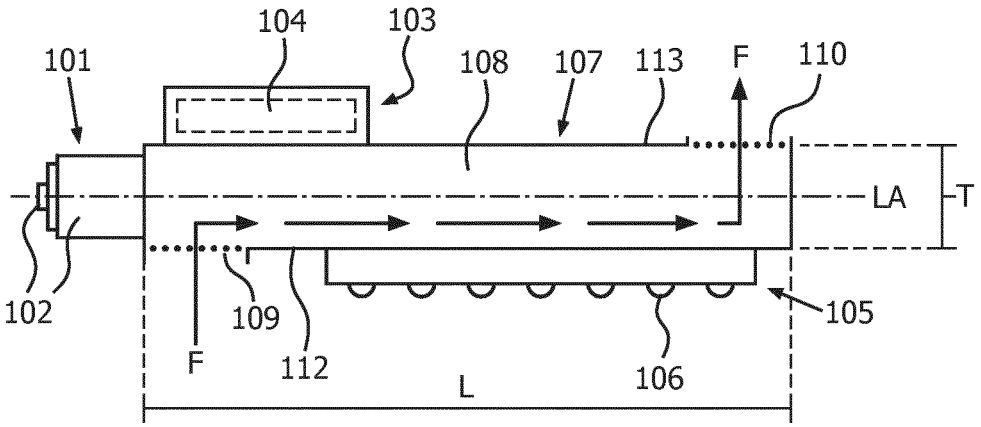
FIG. 2*a*-2*c* schematically depict a cross-section along the longitudinal axis LA of the lighting module according to another embodiment of the present invention.
Figure 2B:
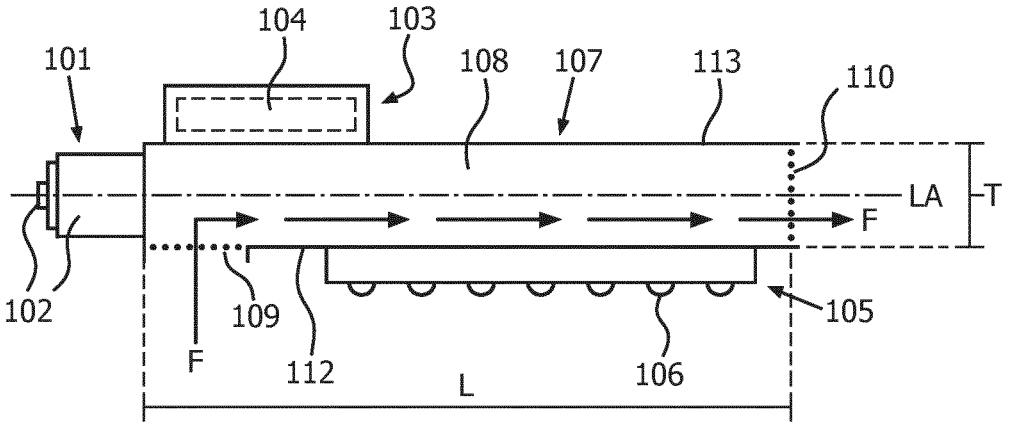
Figure 2C:
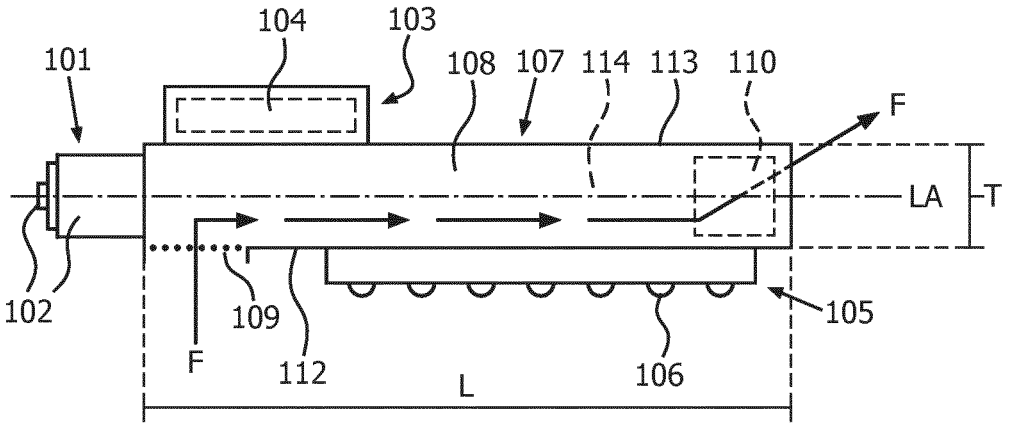

FIG. 2*a*-2*c* schematically depict a cross-section along the longitudinal axis LA of the lighting module 100 according to another embodiment of the present invention. In the embodiment shown in FIG. 2*a*, the fluid inlet 109 is positioned in the first surface 112 and the fluid outlet 110 is positioned in second surface 113 of the elongated hollow tube 108. In the embodiment shown in FIG. 2*b*, the fluid inlet 109 is positioned in the first surface 112 and the fluid outlet 110 is positioned in another surface 114 namely the front surface of the elongated hollow tube 108. In the embodiment shown in FIG. 2*c*, the fluid inlet 109 is positioned in the first surface 112 and the fluid outlet 110 is positioned in another surface 114 namely a side surface of the elongated hollow tube 108. Fluid, such as air, surrounding the edges of the elongated hollow tube 108 and the fluid outlet 110 will also begin to flow in the direction of the fluid flow F inside the elongated hollow tube 108. This process is called entrainment. Entrainment increases cooling of the elongated hollow tube 108 and thus improves cooling of the light unit 105.

Figure 3:
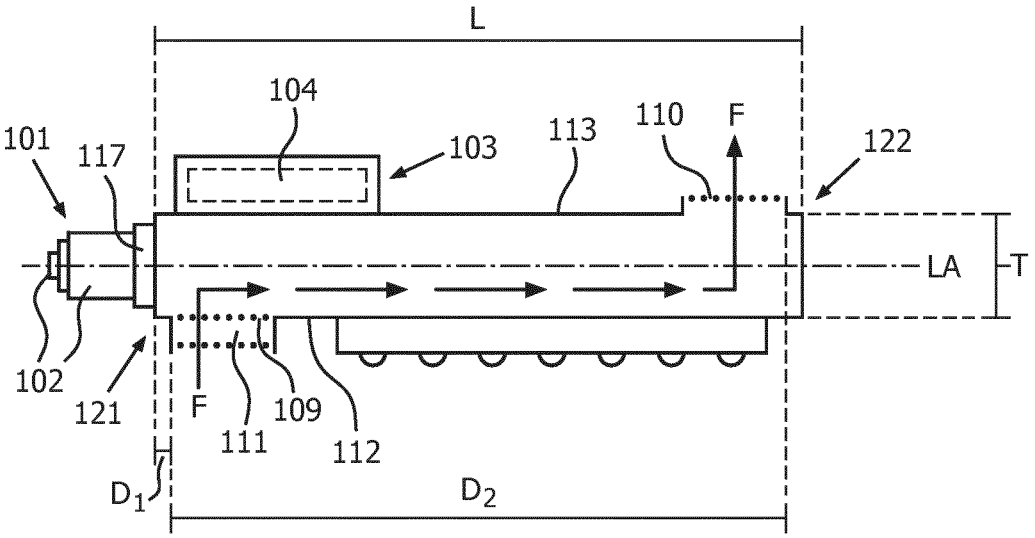
FIG. 3 schematically depicts a cross-section along the longitudinal axis LA of the lighting module according to another embodiment of the present invention.

FIG. 3 schematically depicts a cross-section along the longitudinal axis LA of the lighting module 100 according to another embodiment of the present invention. In the embodiment shown in FIG. 3, the fluid inlet 109 is positioned at a distance D1 from a first end 121 of the elongated hollow tube 108. The distance D1 is 0.2 times the length L or less. The fluid inlet 109 may also be positioned at a distance D1 from the first end 121 of the elongated hollow tube 108, wherein the distance D1 is 0.1 times the length L or less. For example, the fluid inlet 109 may be positioned directly at the first end 121 of the elongated hollow tube 108.

In the embodiment shown in FIG. 3, the fluid outlet 110 is positioned at a distance D2 from the second end 122 of the elongated hollow tube 108. The distance D2 is 0.2 times the length L or less. The fluid outlet 110 may also be positioned at a distance D2 from the second end 122 of the elongated hollow tube 108, wherein the distance D2 is 0.1 times the length L or less. For example the fluid outlet 110 may be positioned directly at the second end 122 of the elongated hollow tube 108. The fluid inlet 109 may be preferably positioned close to the base 101 of the lighting module 100. The fluid inlet 109 may also be positioned at a distance D1 from the first end 121 of the elongated hollow tube 108 wherein the distance D1 is 0.2 times the length L or less, the fluid outlet 110 may also be positioned at a distance D2 from the second end 122 of the elongated hollow tube 108 wherein the distance D2 is 0.2 times the length L or less, and wherein (D1+D2) is 0.2 times the length L or less. The distance between the first inlet of the elongated hollow tube and the second outlet of the elongated hollow tube may be at least 0.8 times the length of the elongated hollow tube.

In the embodiment shown in FIG. 3, the driver unit 103 is in thermal contact with the elongated hollow tube 108 to remove heat from the driver unit 103. For example, the area where the driver unit 103 contacts the elongated hollow tube 108 is made from a material with a high thermal conductivity. For example, the thermal conductivity of the area where the driver unit 103 contacts the elongated hollow tube 108 is at least 50 $W \cdot m^{-1} \cdot K^{-1}$, or at least 100 $W \cdot m^{-1} \cdot K^{-1}$, or at least 150 $W \cdot m^{-1} \cdot K^{-1}$. For example, the area where the driver unit 103 contacts the elongated hollow tube 108 made of aluminium which thermal conductivity is about 200 $W \cdot m^{-1} \cdot K^{-1}$ or made of copper which thermal conductivity is about 400 $W \cdot m^{-1} \cdot K^{-1}$. The driver circuit 104 is in thermal contact with the driver unit 103. In another example, the driver circuit 104 is in direct thermal contact with the elongated hollow tube 108.

In the embodiment shown in FIG. 3, the driver unit 103 is positioned asymmetrically over the length L of the elongated hollow tube 108. The center of the driver unit 103 is positioned at a closer distance to the fluid inlet 109 than to the fluid outlet (110). For example, the driver unit 103 is placed at the first end 121 of the elongated hollow tube 108 and extends not at the full length of the elongated hollow tube 108.

Figure 4:
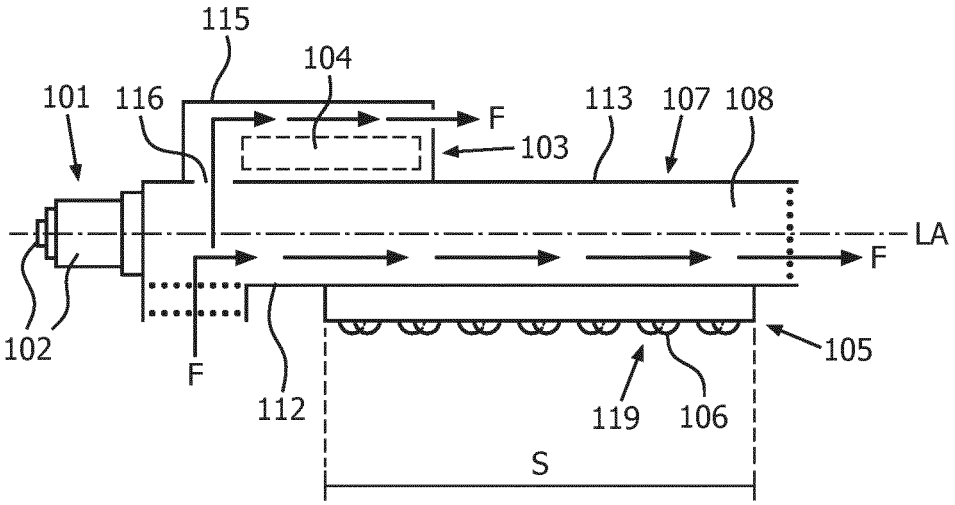
FIG. 4 schematically depicts a cross section along the longitudinal axis LA of a lighting module according to another embodiment of the present invention.

FIG. 4 schematically depicts a cross section along the longitudinal axis LA of a lighting module according to another embodiment of the present invention. In the embodiment shown in FIG. 4, the driver unit 103 comprises a further elongated hollow tube 115 which has a further fluid hole 116 being in fluid connection with the first mentioned elongated hollow tube 108. For example, the further elongated hollow tube 115 may be a separate part of the heat sink 107. In another example the further elongated hollow tube 115 may form a single piece together with the elongated hollow tube 108. The single piece is preferably made of the same material. The obtained effect is improved cooling of the driver unit.

In the embodiment shown in FIG. 4, the lighting module 100 comprises a rotation mechanism 117 which rotates the elongated hollow tube 108 with respect to the base 101 and the longitudinal axis LA. The rotation mechanism may, for example as disclosed in WO2016012330, comprise a first part and a second part. The second part overlaps the first part. The first is provided with a notch. The second part is provided with a guiding slot. The notch protrudes into the guiding slot and is movable along the guiding slot so as to allow rotation of the light source(s) with respect to the longitudinal axis LA. The guiding slot may extend for about 180 degrees. The rotation mechanism 117 may also be based on any other rotation principle known in the prior art.

In the embodiment shown in FIG. 4, the solid state light source 106 comprises a plurality of solid state light emitters 118 which are arranged in an elongated solid state light emitter array 119 which extends in the direction of the longitudinal axis LA and wherein the size S of the elongated solid state light emitter array 119 which extends parallel with respect to the longitudinal axis LA is at least 0.7 times the length L. For example, the solid state light emitters 118 are light emitting diodes (LEDs) or laser diodes. For example, the solid state light emitters 118 emit white light.

Figure 5:
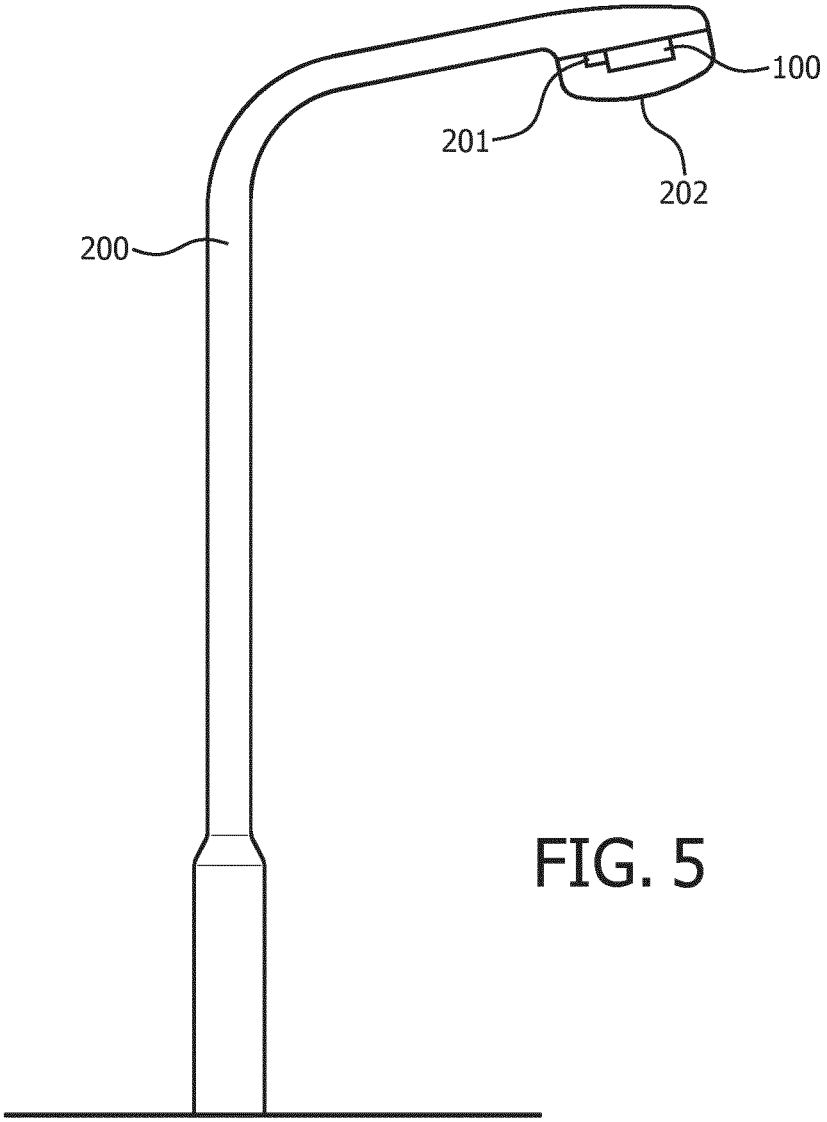
FIG. 5 schematically depicts a side view of a luminaire comprising a lighting module according to another embodiment of the present invention.

FIG. 5 schematically depicts a side view of a luminaire comprising a lighting module according to another embodiment of the present invention. In the embodiment shown in FIG. 5, the luminaire 200 comprises the lighting module 100. For example, the luminaire is a street lighting luminaire. The base 101 of the lighting module 100 is connected to a luminaire socket 201 of the luminaire 200. The luminaire 200 may comprise a light exit 202. For example, the light exit 202 may comprise a transparent plate.

The term luminaire 200 may define a fixture or any other device for holding a lamp, and optionally a reflector.

For example, when the lighting module 100 is applied in a streetlamp it provides high lumen-output and high utilization of the light which, and it enables to replace a conventional high pressure sodium lamp without modification of the associated luminaire 200.

Examples of solid state light emitters are Light Emitting Diodes (LEDs), Organic Light Emitting diode(s) OLEDs, or, for example, laser diodes. Solid state light emitters are relatively cost effective, have a relatively large efficiency and a long life-time. The LED light source may be a phosphor converted LED (a LED comprising a luminescent material) or a colored LED (a LED not comprising a luminescent material). The luminescent material is arranged for converting at least part of the light emitted by the LED into light of a longer wavelength. The luminescent material may be an organic phosphor, an inorganic phosphor and/or a quantum dot based material.

The lighting module 100 may be configured to provide white light. The term white light herein, is known to the person skilled in the art and relates to white light having a correlated color temperature (CCT) between about 2.000 K and 20.000 K. In an embodiment the CCT is between 2.500 K and 10.000K. Usually, for general lighting, the CCT is in the range of about 2700K to 6500K. Preferably, it relates to white light having a color point within about 15, 10 or 5 SDCM (standard deviation of color matching) from the BBL (black body locus). Preferably, it relates to white light having a color rendering index (CRI) of at least 70 to 75, for general lighting at least 80 to 85.

The term "substantially" herein, such as in "substantially all light" or in "substantially consists", will be understood by the person skilled in the art. The term "substantially" may also include embodiments with "entirely", "completely", "all", etc. Hence, in embodiments the adjective substantially may also be removed. Where applicable, the term "substantially" may also relate to 90% or higher, such as 95% or higher, especially 99% or higher, even more especially 99.5% or higher, including 100%. The term "comprise" includes also embodiments wherein the term "comprises" means "consists of". The term "and/or" especially relates to one or more of the items mentioned before and after "and/or". For instance, a phrase "item 1 and/or item 2" and similar phrases may relate to one or more of item 1 and item 2. The term "comprising" may in an embodiment refer to "consisting of" but may in another embodiment also refer to "containing at least the defined species and optionally one or more other species".

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The devices herein are amongst others described during operation. As will be clear to the person skilled in the art, the invention is not limited to methods of operation or devices in operation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention further applies to a device comprising one or more of the characterizing features described in the description and/or shown in the attached drawings. The invention further pertains to a method or process comprising one or more of the characterizing features described in the description and/or shown in the attached drawings.

The various aspects discussed in this patent can be combined in order to provide additional advantages. Further, the person skilled in the art will understand that embodiments can be combined, and that also more than two embodiments can be combined. Furthermore, some of the features can form the basis for one or more divisional applications.

The invention claimed is:

1. A lighting module for use in a luminaire and comprising:

a base having a longitudinal axis (LA) and comprising an electrical connector for connecting the lighting module to a luminaire socket of the luminaire, and a driver unit comprising a driver circuit electrically connected to the electrical connector, a light unit comprising at least one solid state light source electrically connected to the driver circuit and configured for emitting light, a heat sink configured for removing heat from the at least one solid state light source, the heat sink comprises an elongated hollow tube extending in the direction of the longitudinal axis (LA) and comprising a fluid inlet and a fluid outlet, wherein the heat sink is arranged between the driver unit and the light unit wherein the light unit is positioned on a first surface of the elongated hollow tube and the driver unit is positioned on a second surface of the elongated hollow tube wherein the second surface is opposite to the first surface.

2. A lighting module according to claim 1, wherein the elongated hollow tube is the heat sink.

3. A lighting module according to claim 1, wherein the elongated hollow tube comprises an active cooling device configured for generating a fluid flow from the fluid inlet to the fluid outlet.

4. A lighting module according to claim 1, wherein the elongated hollow tube has a thickness T for separating the light unit and the driver unit and a length L extending in the direction of the longitudinal axis (LA), wherein the length L is at least 5 times the thickness T.

5. A lighting module according to claim 1, wherein the thickness T is in the range from 5 mm to 50 mm.

6. A lighting module according to claim 5, wherein the length L is in the range from 70 mm to 700 mm.

7. A lighting module according to claim 4, wherein the fluid inlet is positioned in the first surface and the fluid outlet is positioned in another surface of the elongated hollow tube.

8. A lighting module according to claim 1, wherein the fluid inlet is positioned at a distance D1 from a first end of the elongated hollow tube, wherein the distance D1 is 0.2 times the length L or less.

9. A lighting module according to claim 1, wherein the fluid outlet is positioned at a distance D2 from a second end of the elongated hollow tube, wherein the distance D2 is 0.2 times the length L or less.

10. A lighting module according to claim 1, wherein the driver unit is in thermal contact with the elongated hollow tube for removing heat from the driver unit.

11. A lighting module according to claim 1, wherein the driver unit is positioned asymmetrically over the length L of the elongated hollow tube, wherein the center of the driver unit is positioned at a closer distance to the fluid inlet than to the fluid outlet.

12. A lighting module according to claim 1, wherein the driver unit comprises a further elongated hollow tube having a further fluid hole being in fluid connection with the first mentioned elongated hollow tube.

13. A lighting module according to claim 1, further comprising a rotation mechanism for rotating the elongated hollow tube with respect to the base and the longitudinal axis (LA).

14. A luminaire comprising said lighting module according to claim 1.

* * * * *